United States Patent [19]

Takada

[11] 4,209,287

[45] Jun. 24, 1980

[54] ROTARY VANE COMPRESSOR WITH START-UP PRESSURE BIASING VANES

[75] Inventor: Haruhiko Takada, Konan, Japan

[73] Assignee: Diesel Kiki Co., Ltd., Tokyo, Japan

[21] Appl. No.: 870,316

[22] Filed: Jan. 18, 1978

Related U.S. Application Data

[62] Division of Ser. No. 711,339, Aug. 4, 1976, Pat. No. 4,135,865.

[30] Foreign Application Priority Data

Aug. 6, 1975 [JP] Japan ..... 50/108896
Sep. 4, 1975 [JP] Japan ..... 50/122272

[51] Int. Cl.[2] ..... F01C 21/04; F04C 29/02; F16K 31/08

[52] U.S. Cl. ..... 418/93; 418/99; 418/100; 251/65

[58] Field of Search ..... 418/84, 87, 91–94, 418/97–100; 184/6.16; 251/65

[56] References Cited

U.S. PATENT DOCUMENTS

| | | | |
|---|---|---|---|
| 2,654,532 | 10/1953 | Nichols | 418/84 |
| 2,785,851 | 3/1957 | Menon | 418/93 |
| 3,243,103 | 3/1966 | Bellmer | 418/87 |
| 3,921,662 | 11/1975 | Hauffe et al. | 251/65 |

FOREIGN PATENT DOCUMENTS

| | | | |
|---|---|---|---|
| 1250741 | 9/1967 | Fed. Rep. of Germany | 251/65 |
| 218967 | 7/1942 | Switzerland | 418/87 |

*Primary Examiner*—John J. Vrablik
*Attorney, Agent, or Firm*—Jordan and Hamburg

[57] ABSTRACT

A rotor is eccentrically mounted in a bore of a housing and formed with radial slots in which vanes are slidably retained. A lubricant passageway leads from an oil sump through the radially inner portions of the slots to a fluid inlet, the oil sump communicating with a fluid outlet passageway leading to an outlet port. The high pressure in the outlet passageway forces oil through the lubricant passageway to lubricate the vanes and urge the vanes into sealing engagement with the inner wall of the bore. Oil sucked from the inlet into the bore lubricates the outer ends of the vanes and is recovered at the outlet and returned to the oil sump. In a first embodiment of the invention a check valve blocks the outlet port until the pressure in the outlet passageway reaches a level sufficient to sealingly press the vanes against the wall of the bore, thereby increasing the speed of pressure buildup in the outlet passageway. In a second embodiment of the invention a first check valve is provided between the bore and the outlet passageway and a second check valve is provided between the bore and lubricant passageway in such a manner that compressed working fluid is introduced into the lubricant passageway to press the vanes against the wall of the bore until sufficient pressure is built up for the oil to effectively press the vanes against the wall of the bore.

7 Claims, 6 Drawing Figures

ROTARY VANE COMPRESSOR WITH START-UP PRESSURE BIASING VANES

This is a division, of application Ser. No. 711,339, filed Aug. 4, 1976 now U.S. Pat. No. 4,135,865.

BACKGROUND OF THE INVENTION

The present invention relates to a rotary compressor which may be advantageously employed in an air conditioning system of an automotive vehicle for compressing a refrigerant fluid.

Rotary compressors are well known in the art which comprise a housing formed with a bore, fluid inlets and outlets communicating with the bore and a rotor mounted in the bore in such a manner that rotation thereof causes a working fluid such as a refrigerant to be compressively displaced from the inlet to the outlet. The rotor is typically provided with radial slots and vanes which are slidably retained in the slots and urged into sealing engagement with the inner wall of the bore. The rotor is eccentrically or similarly disposed in the bore in such a manner that upon rotation of the rotor the vanes divide the bore into fluid chambers of progressively varying volume. The compressor is designed so that the fluid chambers increase in volume in the vicinity of the inlet and decrease in volume in the vicinity of the outlet so that the fluid is sucked into the fluid chambers through the inlet and discharged therefrom through the outlet at elevated pressure. Due to the sealing effect of the vanes the compressor operates on the positive displacement principle.

A unique method has recently been devised to lubricate the rotor without the provision of a separate oil pump. An oil sump is provided below the compressor housing which communicates with the fluid outlet. In this manner the oil in the oil sump is subjected to the outlet pressure of the fluid. An oil passageway leads from the oil sump through the inner portion of the rotor to the fluid inlet in such a manner that oil is forced from the pressurized oil sump through the interior or the rotor to the low pressure fluid inlet.

The rotor comprises a drive shaft and a rotor body fixed to the shaft, the vane slots being formed in the rotor body. The oil passageway leads through the radially inner portions of the vane slots between the vanes and the shaft so that the pressurized oil not only lubricates the areas of sliding contact between the vanes and the walls of the respective slots but also urges the vanes radially outwardly into sealing engagement with the inner wall of the bore.

The oil is sucked along with the working fluid into the fluid chambers in the bore and lubricates the areas of sliding contact between the outer ends of the vanes and the wall of the bore. At the fluid outlet, the oil is separated from the working fluid and returned to the oil sump.

Although such a compressor provides efficient operation and enables a reduction in the number of component parts, a problem is encountered when the compressor is initially started. Due to the design of the compressor, the pressure of the working fluid at the outlet does not build up to an operating value instantaneously, but a significant amount of time is required for this to occur. As a result, the pressure applied to the lubricant for urging the valves into sealing engagement with the wall of the bore also builds up over a period of time and the initial pressure is insufficient to obtain an effective seal.

This has the effect of further delaying the pressure buildup due to leakage of working fluid past the vanes which constitutes inefficient compressor action. In addition, the vanes tend to reciprocally bounce off the wall of the bore due to the insufficient biasing pressure which results in a loud chattering noise and causes damage to the vanes and housing bore. A feasible solution to this problem has heretofore not been proposed.

SUMMARY OF THE INVENTION

It is an object of the present invention to provide a rotary compressor of the type described above in which the problem of vane chattering and insufficient biasing force for the vanes upon starting of the compressor is overcome.

It is another object of the present invention to provide a rotary compressor in which the outlet is sealed upon initial starting of the compressor to cause the internal oil pressure to build up at a faster rate.

It is another object of the present invention to provide a rotary compressor in which working fluid is used to urge rotor vanes into sealing engagement with a wall of a bore until the oil pressure has built up to a sufficient level to accomplish this function.

It is another object of the present invention to provide a generally improved rotary compressor.

Other objects, together with the foregoing, are attained in the embodiments of the present invention described in the following description and shown in the accompanying drawings.

DESCRIPTION OF THE PREFERRED EMBODIMENT

While the rotary compressor of the present invention is susceptible of numerous physical embodiments, depending upon the environment and requirements of use, substantial numbers of the herein shown and described embodiment have been made, tested and used, and all have performed in an eminently satisfactory manner.

Figure 1:
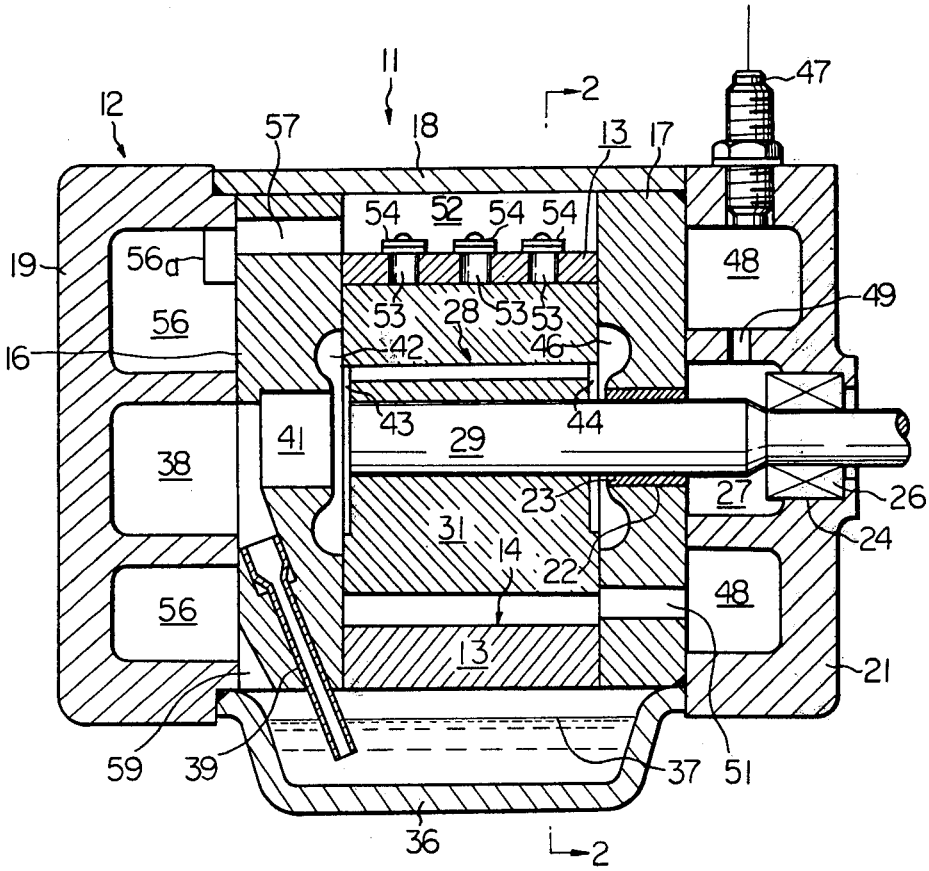
FIG. 1 is a longitudinal sectional view of a first embodiment of a rotary compressor according to the present invention.

Referring now to the drawing, a rotary compressor 11 embodying the present invention comprises a housing which is generally designated as 12. The housing 12 comprises a cylinder 13 which is formed with a bore 14. The left and right ends (as viewed in FIG. 1) of the cylinder 13 are closed by end plates 16 and 17 respectively. The assembly comprising the cylinder 13 and end plates 16 and 17 is supported within a generally cylindrical shell 18. A left end cover 19 and a right end cover 21 are fixed to the end plates 16 and 17 respectively by bolts which are not shown.

The end plate 17 is formed with an opening 22 in which is fitted a rolling contact bearing 23. The bearing 23 is designed with spaces between the rolling elements (not shown) thereof in such a manner that oil may pass longitudinally therethrough.

The right end cover 21 is similarly formed with an opening 24 in which is fitted a bearing 26. Although the bearing 26 may be similar to the bearing 23, the bearing 26 is further provided with an oil seal (not shown) to prevent passage of oil therethrough. The right end plate 21 is further formed with a low pressure oil chamber 27 communicating with the bearings 23 and 26.

A rotor which is generally designated as 28 comprises a drive shaft 29 which is rotatably supported by the bearing 23 and 26. A rotor body 31 is fixed to the shaft 29 for unitary rotation and is formed with radial slots 32 which are shown most clearly in FIG. 2. Vanes 33 are radially slidingly retained in the slots 32 respectively and engage with the inner wall (not designated) of the bore 14.

Although any number of slots 32 and vanes 33 may be provided, the number shown is four each which are circumferentially spaced at intervals of ninety degrees. The cylinder 13, rotor body 31, slots 32 and vanes 33 are coextensive in such a manner that the rotor body 31 and vanes 33 sealingly engage with the end walls 16 and 17. Although various configurations may be provided for the cross-sections of the bore 14 and rotor body 31, the compressor 11 operates in an extremely effective manner if said sections are circular, with the diameter of the bore 14 being greater than the diameter of the rotor body 31. The rotor body 31 is furthermore coaxial with the shaft 29 and sealingly tangent to the inner wall of the bore 14 at the uppermost point thereof, designated as 34. It is clear that the openings 22 and 24 in the end plate 17 and end cover 21 as well as the bearings 23 and 26 and shaft 29 are mutually coaxial and are eccentric relative to the central axis of the bore 14.

A lubricant reservoir or oil sump 36 is mounted to the bottom of the housing 12 and is filled with oil up to a level 37. The left end cover 19 is formed with a high pressure oil chamber 39 which communicates with the oil sump 36 below the oil level 37 through a tube 39. The end plate 16 is formed with an opening 41 which provides communication between the high pressure oil chamber 38 and the left end of the rotor 28 as viewed in FIG. 1. The right face of the left end plate 16 is formed with a circular recess 42 coaxial with the opening 41 and the shaft 29. The left face of the rotor body 31 is formed with a circular recess 43 conjugate to the recess 42. In this manner, the radially inner portions of the slots 32 in the rotor body 31 communicate with the oil sump 36 through the recesses 43 and 42, the opening 41, the high pressure oil chamber 38 and the tube 39.

The right face of the rotor body 31 is formed with a circular recess 44 and the left face of the end plate 17 is formed with a conjugate circular recess 46. In this manner, the slots 32 communicate with the low pressure oil chamber 27 through the recesses 44 and 46 and the bearing 23.

Where the compressor 11 is employed to circulate a refrigerant fluid in an automotive air conditioning system, a fluid inlet port 47 is connected to an evaporator unit (not shown). The inlet port 47 leads into an annular inlet chamber 48 formed in the end cover 21. The low pressure oil chamber 27 communicates with the inlet chamber 48 through an opening 49. As best viewed in FIG. 2, a generally crescent shaped inlet orifice 51 leads from the inlet chamber 48 into the bore 14. The upper portion of the cylinder 13 is cut away to form an outlet passageway 52, which communicates with the bore 14 through outlet orifices 53. Check valves 54 are provided at the outlet orifice 53 respectively to prevent reverse flow through the compressor 11. The left end cover 19 is formed with an annular outlet chamber 56 which communicates with the outlet passageway 52 through a passageway 57 formed through the end plate 16, which constitutes an extension of the outlet passageway 52, and an oil separator **56*a*. The outlet chamber 56 is connected as will be described in detail below through an outlet port 58 to a condenser (not shown) of the air conditioning system, and communicates with the oil sump 36 through a passageway 59 formed through the end wall 16. The basic compressor 11 described thus far operates as follows. The shaft 29 is connected to a crankshaft of the automobile engine through an electromagnetic clutch (not shown). To operate the air conditioner and thereby the compressor 11, the electromagnetic clutch is engaged to rotatably drive the shaft 29 counterclockwise in FIG. 2**.

Figure 2:
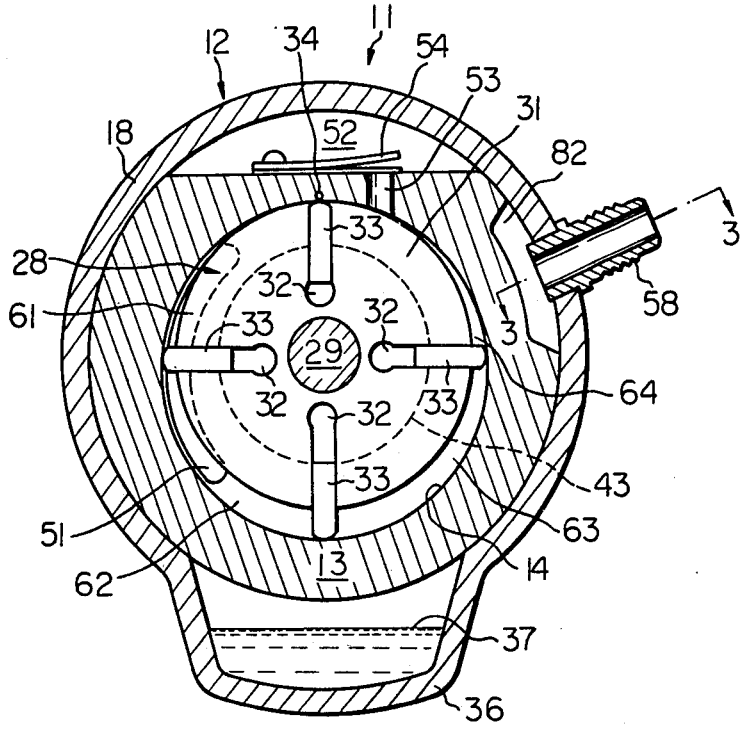
FIG. 2 is a side sectional view of the compressor taken on line 2—2 of FIG. 1.
Figure 3:
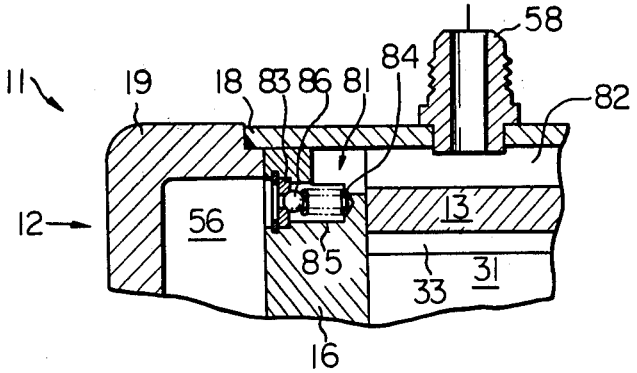
FIG. 3 is an enlarged sectional view of a valve assembly of the compressor taken on a line 3—3 in FIG. 2.

As shown in FIG. 2, the vanes 33 in conjunction with the rotor body 31 and the inner wall of the bore 14 divide the space between the rotor body 31 and inner wall into four fluid chambers shown as occupying positions 61, 62, 63 and 64. It will be noticed that the volumes of the fluid chambers in positions 61 and 64 are small and the volumes of the fluid chambers in positions 62 and 63 are larger. The fluid chamber in position 61 is located in the vicinity of the inlet orifice 51 whereas the fluid chamber in position 64 is located in the vicinity of the outlet orifices 53. Counterclockwise rotation of the rotor 28 causes the fluid chamber in position 61 to progressively occupy the positions 62, 63 and 64.

In this manner, the volume of each fluid chamber increases while the fluid chamber is in communication with the inlet orifice 51 thereby sucking working fluid or refrigerant thereinto through the inlet port 47 and inlet chamber 48. This creates a partial vacuum or low absolute pressure in the inlet chamber 48.

As the trailing vane 33 of each fluid chamber passes the counterclockwise end of the inlet orifice 51, the fluid chamber is sealed. As each fluid chamber passes through position 63 and approaches position 64, the volume thereof decreases thereby compressing the working fluid therein. As the leading vane 33 of each fluid chamber passes the outlet orifices 53, the fluid is discharged therefrom through the outlet chamber 56 and the outlet port 58 to the condenser. As the trailing vane 33 of each fluid chamber approaches the outlet orifices 53, the volume of the fluid chamber is extremely low and the working fluid is forced out through the outlet orifices 53. With the rotor body 31 sealingly engaging with the wall of the bore 14 at 34, each fluid chamber in the vicinity of the outlet orifices 53 is defined between the seal point 34 and the trailing vane 33 of the fluid chamber, so that the volume of the fluid chamber is extremely low. The pressure in the outlet chamber 56 is quite high due to the compressor action.

The rotor 28 and bearings 23 and 26 are lubricated as follows. Since the pressure in the outlet chamber 56 is high and is applied to the oil sump 36 through the passageway 59, the pressure in the oil sump 36 is high. Conversely, the pressure in the inlet chamber 48 is low. This pressure difference causes oil from the sump 36 to flow into the low pressure oil chamber 27, which communicates with the inlet chamber 48 through the opening 49, through the tube 39, high pressure oil chamber 38, grooves 42 and 43, slots 32 in the rotor body 31, grooves 44 and 46 and bearing 23. This pressurized oil in the radially inner portions of the slots 32 serves the dual function of lubricating the sliding contact areas of the vanes 33 and slots 32 and urging the vanes 33 radially outwardly into sealing engagement with the inner wall of the bore 14. The bearing 23 is lubricated by the oil passing therethrough and the bearing 26 is lubricated by the oil in the low pressure oil chamber 27.

The oil is sucked from the low pressure oil chamber 27 through the opening 49, inlet chamber 48 and inlet orifice 51 into the bore 14 where it serves to lubricate the sliding contact areas of the outer ends of the vanes 33 and the inner wall of the bore 14. The oil is discharged along with the working fluid through the outlet orifices 53 and enters the oil separator 56*a*. The oil is removed from the working fluid by the oil separator 56*a* and is returned to the oil sump 36 through the outlet chamber 56 and passageway 59. The working fluid, with the oil removed, is pumped out of the compressor 11 through the outlet port 58 to the condenser.

Although the basic compressor 11 described above functions effectively and efficiently after it has been started and run for a period of time, the pressures in the outlet chamber 56, oil sump 36 and high pressure oil chamber 38 do not instantaneously attain an operating level after the compressor 11 is started. As a result, the oil pressure in the inner portions of the slots 32 of the rotor body 31 is insufficient to urge the vanes 33 into sufficient sealing engagement with the wall of the bore 14. This causes reciprocal bouncing of the vanes 33 off the wall of the bore 14 and a consequent loud chattering noise and damage to the ends of the vanes 33 and the wall of the bore 14.

To overcome this problem, the present invention provides a check valve 81 to control communication between the outlet chamber 56 and outlet port 58. A secondary outlet chamber 82 formed in the cylinder 13 is circumferentially spaced from the outlet passageway 52 and communicates with the outlet port 58. The check valve 81 is disposed in an opening 85 formed through the end wall 16 between the outlet chamber 56 and the secondary outlet chamber 82 and comprises a valve seat 83. A valve compression spring 84 urges a valve element shown as a ball 86 toward sealing engagement with the valve seat 83 to block communication between the outlet chamber 56 and the secondary outlet chamber 82.

The ball 86 is exposed to the pressure in the outlet chamber 56 and is movable thereby against the force of the spring 84 off the seat 83 to communicate the outlet chamber 56 with the outlet port 58 when the pressure in the outlet chamber 56 exceeds a predetermined value corresponding to the preload of the spring 84.

When the compressor 11 is started, the pressure in the outlet chamber 56 is below the predetermined value and the outlet chamber 56 is disconnected from the condensor of the refrigerant circuit by the check valve 81. In this manner, the pressure in the outlet chamber 56 rises much more quickly than if the outlet chamber 56 were connected to the external condenser and in only a few rotations of the rotor 28 the pressures in the outlet chamber 56, oil sump 36 and high pressure oil chamber 38 are sufficient to effectively urge the vanes 33 into sealing engagement with the wall of the bore 14.

Due to the rapid pressure buildup in the high pressure oil chamber 38, the problem of chattering and insufficient sealing of the vanes 33 is completely overcome. As the pressure in the outlet chamber 56 reaches the predetermined value, the ball 86 is moved off the seat 83 thereby connecting the outlet chamber 56 to the outlet port 58 therethrough. Thereafter, the compressor 11 operates in the normal manner described above and delivers working fluid at high pressure to the condenser of the air conditioning system.

If desired, the valve seat 83 may be formed of a permanent magnetic material and the ball 86 be formed of a ferromagnetic material so that the ball 86 is magnetically attracted to the valve seat 83. Alternatively, the ball 86 may be magnetic and the valve seat 83 ferromagnetic. In this manner, the pressure in the outlet chamber 56 required to initially move the ball 86 out of engagement with the valve seat 83 must be sufficient to overcome the preload of the spring 84 and the magnetic attractive force between the valve seat 83 and ball 86.

After the ball 86 is moved off the valve seat 83, however, the pressure in the outlet chamber 56 required to maintain the ball 86 out of engagement with the valve seat 83 must be sufficient only to overcome the force of the spring 84, since the magnetic attractive force decreases sharply with distance. Therefore, the outlet port 58 is blocked until the pressures in the outlet chamber 56 and high pressure oil chamber 38 reach values which are higher than the normal operating values of the compressor 11, thereby ensuring a rapid pressure buildup and effective sealing engagement between the vanes 33 and wall of the bore 14 in a short period of time after starting the compressor 11.

Figure 4:
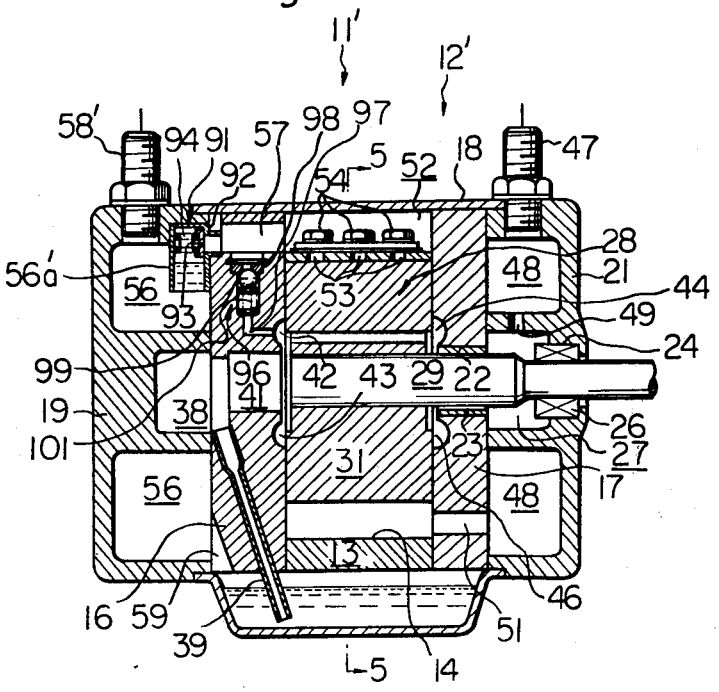
FIG. 4 is a longitudinal sectional view of a second embodiment of a rotary compressor according to the present invention.
Figure 5:
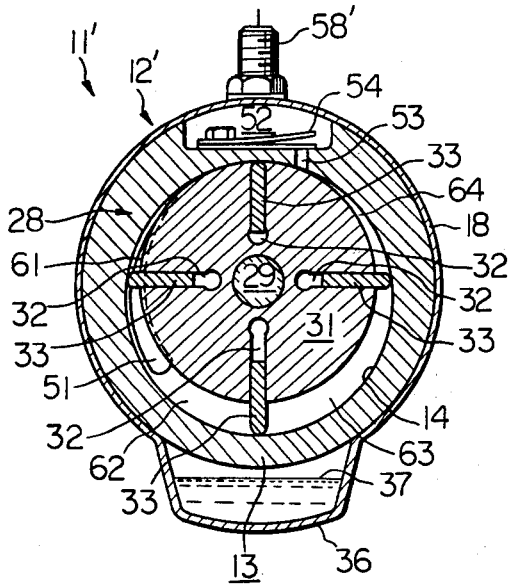
FIG. 5 is a side elevational view of the compressor taken on a line 5—5 in FIG. 4.

A second embodiment of a compressor according to the present invention is shown in FIGS. 4 and 5 and designated as 11'. Since the basic configuration of the compressor 11' is essentially similar to that of the compressor 11, like elements are designated by the same reference numerals and numerals for slightly modified elements are suffixed by an apostrophe.

Differing from the compressor 11, the compressor 11' does not comprise the check valve 81 between the outlet chamber 56 and outlet port 58, but an outlet passageway 56' and outlet port 58' are connected directly together. Instead, a check valve 91 is provided to a modified oil separator 56*a*' to control communication between the outlet passageway 52 and outlet chamber 56 through the passageway 57. The check valve 91 comprises a valve seat 92 and a check valve element 93 which is urged into sealing engagement with the valve seat 92 by a check valve compression spring 94. The valve seat 92 is formed of a permanent magnetic material and the valve element 93 is formed of a ferromagnetic material such as iron or steel so that the valve element 93 is magnetically attracted to the valve seat 92.

In addition, a pressure valve 96 is provided in a pressure passageway 97 which leads from the passageway 57 to the circular recess 42. The valve 96 comprises a valve seat 98 and a valve element in the form of a ball 99 which is urged into sealing engagement with the valve seat 98 by a valve compression spring 101. The pressure in the passageway 57, which is essentially the same as the pressure in the outlet passageway 52, acts against the spring 101 to urge the ball 99 off the valve seat 98. If desired, the valve seat 98 may be magnetic and the ball 99 ferromagnetic.

The valves 91 and 96 are designated according to the relation $P1>P2>P3$. P1 is the pressure in the outlet passageway 52 sufficient to initially move the valve element 93 of the check valve 91 off the seat 92, thereby overcoming the force of the spring 94 and the magnetic attractive force between the valve seat 92 and valve element 93. P2 is the pressure in the outlet passageway 52 sufficient to move the ball 99 of the pressure valve 96 off the valve seat 98, thereby overcoming the force of the spring 101. P3 is the pressure in the outlet passageway 52 sufficient to maintain the valve element 93 of the check valve 91 out of engagement with the valve seat 92 after it has been initially moved out of engagement therewith, thereby substantially overcoming the force of only the spring 94. Also, the pressure P3 is greater than the pressure drop between the passageway 57 and outlet chamber 56 under normal operating conditions.

As the compressor 11' is started, the pressure in the outlet passageway 52 increases rapidly since the outlet passageway 52 is disconnected from the outlet chamber 56 by the closed check valve 91 and essentially sealed. The pressure valve 96 is also closed thereby disconnecting the outlet passageway 52 from the recess 42 and high pressure oil chamber 38.

As the pressure in the outlet passageway 52 rises above P2, the pressure valve 96 opens thereby communicating the recess 42 and the inner portions of the slots 32 with the outlet chamber 52 through the pressure passageway 97. Working fluid from the outlet passageway 52 at high pressure is introduced into the inner portions of the slots 32 thereby urging the vanes 33 strongly against the wall of the bore 14. The effective sealing engagement thus established further promotes a rapid pressure buildup in the outlet passageway 52. Since the inner portions of the slots 32 and the bearing 23 act as a flow restriction, the pressure in the inlet chamber 48 is not substantially increased through connection thereof with the outlet passageway 52 through the pressure passageway 97.

As the pressure in the outlet passageway 52 further increases to P1 due to the compressor action, the check valve 91 opens thereby connecting the outlet passageway 52 to the outlet chamber 56 and the external refrigerant circuit through the outlet port 58'. This causes the pressure in the outlet passageway 52 to drop below P2 thereby closing the valve 96. However, the pressure in the pressure passageway 52 remains above P3 so that the valve 91 remains open. Thereafter, the compressor 11' functions in the normal operating manner described above with lubricant oil being supplied to the rotor 28 through the tube 39 and high pressure oil chamber 38 from the oil sump 36.

The embodiment of FIGS. 4 and 5 is advantageous in that the pressure of the working fluid in the outlet passageway 52 builds up faster than the pressure in the oil sump 36, and by applying working fluid to the slots 32 through the pressure passageway 97, the vanes 33 can be effectively pressed against the wall of the bore 14 much sooner after starting the compressor 11' than if oil were used from the beginning. The pressure in the outlet passageway 52 builds up to P1 extremely quickly since the volume thereof is small and the outlet passageway 52 is effectively sealed by the valve 91. With the pressure in the outlet passageway 52 at P1, which is higher than the normal operating value which is between P3 and P2, when the outlet passageway 52 is connected to the oil sump 36 through the valve 91, the pressure in the oil sump 36 increases almost instantaneously to a value at which the oil forced therefrom to the slots 32 is sufficient to effectively urge the vanes 33 into sealing engagement with the wall of the bore 14.

Figure 6:
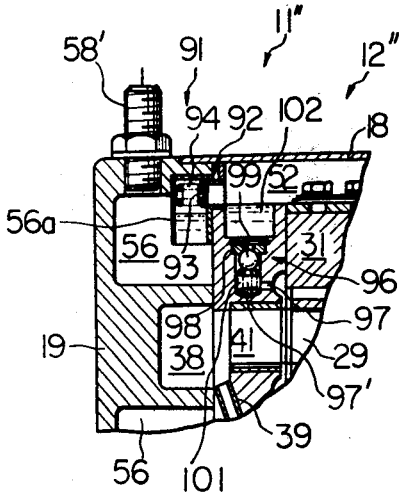
FIG. 6 is a fragmentary longitudinal sectional view showing a modification of the compressor shown in FIG. 4.

FIG. 6 illustrates a modification of the compressor 11' which is designated as 11''. In this embodiment, the upper portion of the pressure passageway 97' above the pressure valve 96 is enlarged to serve as a secondary oil reservoir 102. During normal operation of the compressor 11'' with the pressure valve 96 closed, oil entrained in the operating fluid tends to accumulate in the reservoir 102 such that after a period of operation the reservoir 102 becomes filled. When the compressor 11'' is stopped and subsequently restarted, the oil in the reservoir 102 is forced along with the working fluid through the pressure passageway 97' when the pressure valve 96 opens into the slots 32 to ensure lubrication of the vanes 33 during the initial starting period of the compressor 11''. If the reservoir 102 is made large enough, only oil will be supplied to the slots 32 through the pressure passageway 97'.

Whereas the embodiments of the present invention shown and described constitute preferred forms thereof, many modifications within the scope of the invention will become possible for those skilled in the art after receiving the teachings of the present disclosure.

What is claimed is:

1. A rotary compressor comprising:

a housing formed with a bore;

a fluid inlet passageway leading into the bore;

a fluid outlet passageway leading from the bore to a fluid outlet port;

a rotor operatively disposed in the bore in such a manner as to compressively displace fluid from the inlet passageway to the outlet passageway upon rotation thereof;

a lubricant reservoir communicating with the outlet passageway;

a lubricant passageway leading from the lubricant reservoir to the inlet passageway and communicating with the rotor in such a manner that lubricant is caused to flow through the lubricant passageway thereby lubricating the rotor when the pressure in the outlet passageway is greater than the pressure in the inlet passageway;

first valve means provided in the outlet passageway and arranged to close thereby blocking communication of the bore with the outlet port through the outlet passageway when the pressure in the outlet passageway is below a predetermined value and to open thereby communicating the bore with the outlet port through the outlet passageway when the pressure in the outlet passageway is above the predetermined value;

a pressure passageway leading from the outlet passageway to the lubricant passageway; and pressure valve means provided in the pressure passageway and exposed to the pressure in the outlet passageway to open and close the pressure passageway in accordance with the relation:

$$P1 > P2 > P3$$

where P1 is the predetermined value of pressure in the outlet passageway and is an initial opening pressure of the first valve means, P2 is a predetermined value of pressure in the outlet passageway which is an opening pressure of the pressure valve means and P3 is a predetermined value of pressure in the outlet passageway which is sufficient to maintain the first valve means open after the first valve means is initially opened.

2. A rotary compressor as in claim 1, in which the housing is further formed with an outlet chamber communicating with the outlet passageway, the first valve means being provided to control communication between the outlet chamber and the outlet passageway.

3. A rotary compressor as in claim 1, in which the first valve means comprises a valve seat, a valve element and a valve spring urging the valve element toward sealing engagement with the valve seat, the valve element being exposed to the pressure in the outlet passageway which urges the valve element away from the valve seat, the valve seat and the valve element being formed of magnetic material in such a manner that the valve element is magnetically attracted toward sealing engagement with the valve seat, P1 and P3 being the predetermined values of pressure in the outlet passageway sufficient to overcome the force of the valve spring and the magnetic force when the valve element is engaged and disengaged from the valve seat respectively.

4. A rotary compressor as in claim 1, in which the housing is further formed with a secondary lubricant reservoir between the outlet passageway and the pressure valve means in such a manner that lubricant is caused to flow from the secondary lubricant reservoir through the pressure valve means and pressure passageway into the lubricant passageway when the pressure valve means is open.

5. A rotary compressor as in claim 1, in which the pressure valve means comprises a valve seat, a valve element and a valve spring urging the valve element into sealing engagement with the valve seat, the valve element being exposed to the pressure in the outlet passageway and being movable thereby against the force of the valve spring to disengage from the valve seat when the pressure in the outlet passageway is above P2.

6. In a rotary compressor comprising:

an outer shell means;

a housing disposed in said outer shell means, said housing being formed with a bore;

a fluid inlet passageway leading into the bore;

an end plate disposed at one longitudinal end of said housing;

an end cover mounted on the end plate;

a first fluid outlet chamber between the outer shell means and the housing;

a second fluid outlet chamber defined at least in part by said end cover and said end plate;

a communicating passage in said end plate communicating the first outlet chamber with the second outlet chamber;

a rotor operatively disposed in the bore in such a manner as to compressively displace fluid from the inlet passageway to the first outlet chamber upon rotation thereof, the rotor comprising a rotor body formed with a plurality of substantially radial slots and a plurality of vanes slidably retained in the slots respectively;

a lubricant reservoir communicating with the second outlet chamber.

a lubricant passageway leading from the lubricant reservoir to the inlet passageway and communicating with the rotor in such a manner that lubricant is caused to flow through the lubricant passageway when the pressure in the second outlet chamber is greater than the pressure in the inlet passageway to thereby lubricate the rotor, part of the lubricant passageway being defined by radially inner portions of the rotor slots so that the lubricant therein urges the vanes radially outwardly into sealing engagement with a wall of the bore;

first valve means provided in the communicating passageway and arranged to close thereby blocking communication between the first and second outlet chambers when the pressure in the first outlet chamber is below a predetermined value such that upon start up of the compressor, the first valve means is closed to block off the second outlet chamber from the first outlet chamber and provide a reduced volume for compressed fluid between the rotor and the first valve means;

a pressure passageway leading from the first outlet chamber to the lubricant passageway; and pressure valve means provided in the pressure passageway and exposed to the pressure in the first outlet chamber to open and close the pressure passageway in accordance with the relation:

$$P1 > P2 > P3$$

where P1 is the predetermined value of pressure in the first outlet chamber and is an initial opening pressure of the first valve means, P2 is a predetermined value of pressure in the first outlet chamber which is an opening pressure of the pressure valve means and P3 is a predetermined value of pressure in the first outlet chamber which is sufficient to maintain the first valve means open after the first valve means is initially opened.

7. A rotary compressor comprising:

a housing formed with a bore;

a fluid inlet passageway leading into the bore;

a fluid outlet passageway leading from the bore to a fluid outlet port;

a rotor operatively disposed in the bore in such a manner as to compressively displace fluid from the inlet passageway to the outlet passageway upon rotation thereof;

a lubricant reservoir communicating with the outlet passageway;

a lubricant passageway leading from the lubricant reservoir to the inlet passageway and communicating with the rotor in such a manner that lubricant is caused to flow through the lubricant passageway thereby lubricating the rotor when the pressure in the outlet passageway is greater than the pressure in the inlet passageway;

first valve means provided in the outlet passageway and arranged to close thereby blocking communication of the bore with the outlet port through the outlet passageway, said first valve means being constructed and arranged to initially open at a first predetermined pressure in the outlet passageway and once opened to remain open until the pressure in the outlet passageway falls below a second predetermined pressure which is less than said first predetermined pressure;

a pressure passageway leading from the outlet passageway to the lubricant passageway, and pressure valve means provided in the pressure passageway and exposed to the pressure in the outlet passageway, said pressure valve means being constructed and arranged to open at a third predetermined pressure which is intermediate said first and second predetermined pressures, whereby upon start up of the rotary compressor with increasing pressure buildup in the outlet passageway, the pressure valve means first opens as the third predetermined pressure is reached and then the first valve means opens as the first predetermined pressure is reached, said opening of said first valve means resulting in a reduction in pressure in said outlet passageway below said third predetermined pressure but not below said second predetermined pressure whereby said pressure valve means closes while said first valve means is maintained open.

* * * * *